US009320404B2

(12) United States Patent
Gornik et al.

(10) Patent No.: US 9,320,404 B2
(45) Date of Patent: Apr. 26, 2016

(54) MOP MEASURING CANISTER AND SYSTEMS AND METHOD THEREFOR

(75) Inventors: Matthew S. Gornik, Arlington Heights, IL (US); Tamara L. Dick, Fox Lake, IL (US)

(73) Assignee: Medline Industries, Inc., Mundelein, IL (US)

( * ) Notice: Subject to any disclaimer, the term of this patent is extended or adjusted under 35 U.S.C. 154(b) by 757 days.

(21) Appl. No.: 13/548,884

(22) Filed: Jul. 13, 2012

(65) Prior Publication Data

US 2014/0014133 A1 Jan. 16, 2014

(51) Int. Cl.

| | |
|---|---|
| ***B65D 75/00*** | (2006.01) |
| ***A47L 13/20*** | (2006.01) |
| ***A47L 13/50*** | (2006.01) |

(52) U.S. Cl.

CPC ..... *A47L 13/20* (2013.01); *A47L 13/50* (2013.01); *Y10T 29/49826* (2015.01)

(58) Field of Classification Search

None

See application file for complete search history.

(56) References Cited

U.S. PATENT DOCUMENTS

2005/0011261 A1 1/2005 Lyon
2008/0264445 A1* 10/2008 Levitt et al. ..... 134/6

OTHER PUBLICATIONS

Markkanen, et al., "Publication", "*Cleaning in Healthcare Facilities*", Published Apr. 2009, Authors: Pia Markkanen, et al., pp. 1-42.

Jcaho Care Standards, "Publication", "*Using Microfiber Mops in Hospitals*", Published Nov. 2002, Authors: Jcaho, pp. 1-4.

Sustainable Hospitals Project, "Publication", "*10 Reasons to Use Microfiber Mopping*", Published Jun. 19, 2003, Author: Sustainable Hospital Project, pp. 1-2.

"Website", "*Using Microfiber Mops in Hospitals*", www.askep.net/pdf/Using-Microfiber-Mops-in-Hospitals.html#, Jul. 5, 2012.

"Medline Catalog", Advantex Microfiber Bucket; Medline Catalog; http://www.medline.com/catalog/catalog.jsp; Unknown Publication date but believed to be prior to present application filing date,.

"Medline Catalog", Backpack Flow Floor Finishing System; Medline Catalog; http://www.medline.com/catalog/catalog.jsp; Unknown Publication date but believed to be prior to present application filing date,.

"Medline Catalog", Easy Shine Applicator Kit by 3M Healthcare; Medline Catalog; http://www.medline.com/catalog/catalog.jsp; Unknown Publication date but believed to be prior to present application filing date,.

"Medline Catalog", Microfiber Charging Bucket with Lid; Medline Catalog; http://www.medline.com/catalog/catalog.jsp; Unknown Publication date but believed to be prior to present application filing date,.

"Medline Catalog", Microfiber Starter Kit; Medline Catalog; http://www.medline.com/catalog/catalog.jsp; Unknown Publication date but believed to be prior to present application filing date,.

(Continued)

*Primary Examiner* — Eric Golightly
(74) *Attorney, Agent, or Firm* — Philip H. Burrus, IV

(57) ABSTRACT

A mop kit (1000) for a moping system and method is disclosed. The mop kit includes a canister with a plurality of demarcations (110,111,112,113,114,115,116,117,118,119) disposed along a sidewall. Each demarcation can correspond to a fluid level suitable for saturating a predetermined number of mop heads. The mop kit can also include a bucket (400) configured to retain the mop heads along a base (401) of the bucket, as well as the predetermined number of mop heads (300).

13 Claims, 11 Drawing Sheets

(56) References Cited

OTHER PUBLICATIONS

"Medline Catalog", Microfiber Wringer Buckets; Medline Catalog; http://www.medline.com/catalog/catalog.jsp; Unknown Publication date but believed to be prior to present application filing date,.

"Medline Catalog", Surgical Mop Kits by Advance Medical; Medline Catalog; http://www.medline.com/catalog/catalog.jsp; Unknown Publication date but believed to be prior to present application filing date,.

"Medline Catalog", UltraFlex Bucket with Castors by Freudenberg; Medline Catalog; http://www.medline.com/catalog/catalog.jsp; Unknown Publication date but believed to be prior to present application filing date,.

"Medline Catalog", UltraFlex Flat Mop Wringers by Freudenberg; Medline Catalog; http://www.medline.com/catalog/catalog.jsp; Unknown Publication date but believed to be prior to present application filing date,.

* cited by examiner

MOP MEASURING CANISTER AND SYSTEMS AND METHOD THEREFOR

BACKGROUND

1. Technical Field

This invention relates generally to canisters, and more particularly to a measurement canister.

2. Background Art

Mopping systems are constantly evolving and improving. Not too long ago, the only mop system available to a user was a cotton-based, string mop. A large bucket accompanied the mop with a porous metal press attached to the top. A user would wet the mop by dipping it in water disposed within the bucket. The user then had to wring it by placing the cotton strings in the press and rotating a lever to wring the water out of the mop. The process was messy and the system components were bulky.

Modern advancements in mop technology have improved the mopping process. For example, new mop designs have eliminated much of the mess associated with the cotton string mops. Additionally, advanced cleaning solutions have allowed mopping to become process that kills microbes and bacteria in addition to removing dirt from a surface. One problem associated with these new technologies is that they can be difficult to learn. A cleaner who is experienced with using a cotton string mop may not, for example, understand the best practices associated with using another type of mop.

It would be advantageous to have systems and methods that made the use of new technologies simpler.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
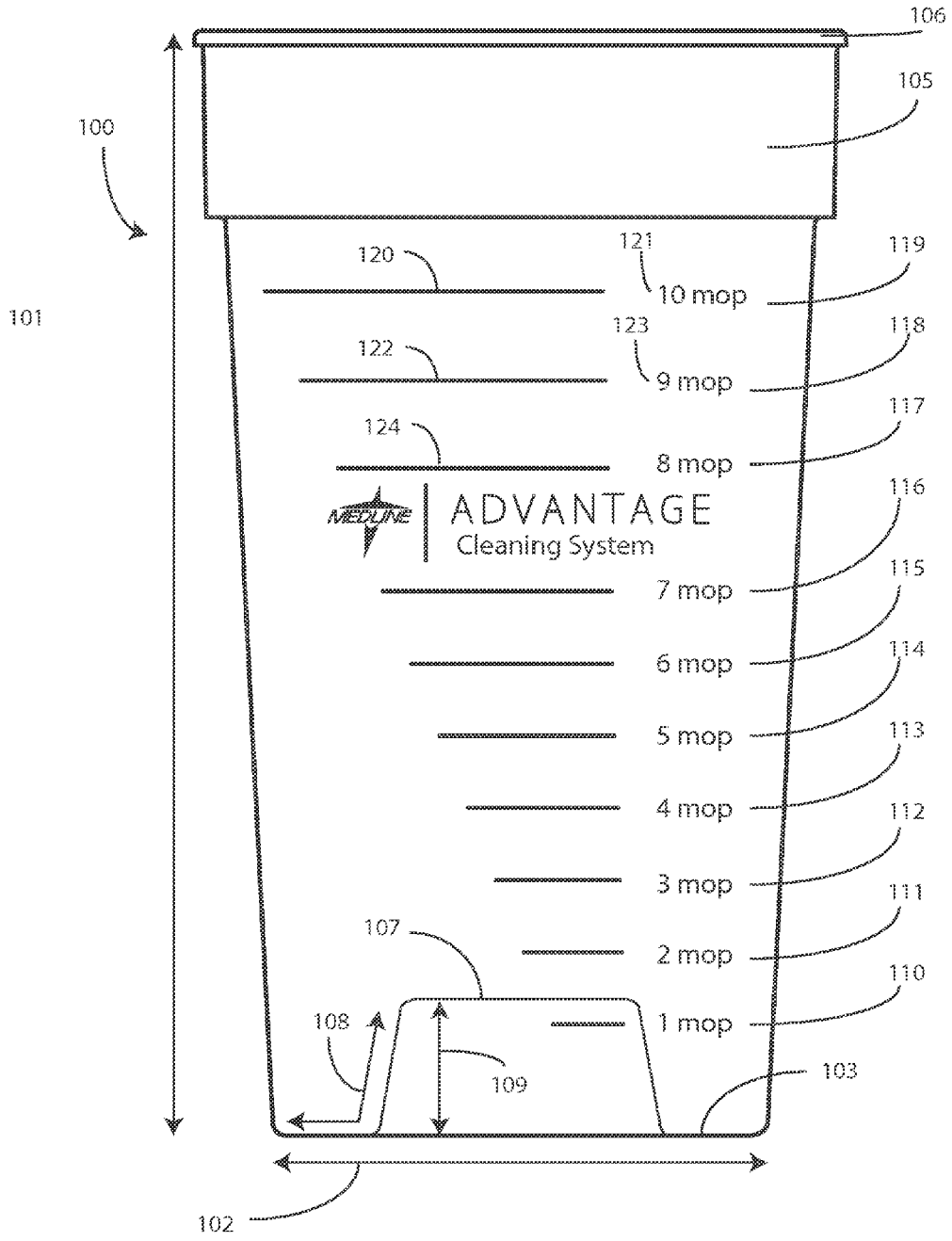
FIG. 1 illustrates a front elevation view of one explanatory measurement canister configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

One technological advance that has improved mopping processes is the development of the microfiber. Microfibers are synthetic fibers having a thickness of less than one denier. Microfibers are used to make non-woven, woven, and knitted textile products. Microfibers are commonly used in mop heads. Microfiber mops include a lightweight handle that is attached to a maneuverable, rectangular, head. Microfiber mops generally attach to the head using a hook and loop system. After soaking up cleaning solution, the microfiber mop can be used to mop a floor. The use of microfiber mops has been encouraged because microfiber mopping can be more efficient and less tiring than when using conventional, heavy, cotton string mops. Further, microfibers are much more absorbent than are their cotton string counterparts.

One problem associated with prior art microfiber mopping systems is that users do not know how much cleaning solution to apply to a microfiber mop head. Consequently, the users are instructed to soak the microfiber mop head in a basin of cleaning solution on a work cart. Once thoroughly soaked, the user is instructed to hand wring the microfiber mop head prior to attaching it to the mop. This is problematic for several reasons. First, it wastes cleaning solution. As noted above most cleaning solutions today include not only cleansers, but antimicrobial and antibacterial chemicals as well. When those chemicals remain in a basin at the end of the day, they must be discarded, which increases the overall mopping cost. Second, the chemicals can be harmful to the user. Some facilities use hazardous chemicals as cleaning agents, including butoxyethanol, quarternary ammonium compounds, and phenols. These chemicals can cause respiratory irritation and skin burns. Asking users to hand wring mop heads can lead to health related issues.

Embodiments of the present invention provide methods and systems that ensure the exact amount of cleaning solution that can be absorbed by a predetermined number of mop heads is used in the mopping process. Not only does this eliminate the need for handwringing mop heads, but it also results in a more economical process due to the fact that cleaning solution is not wasted. Further, the systems and methods described herein are more environmentally friendly in that excess cleaning solutions need not be discarded into public sewage systems.

The fundamental issue that embodiments of the invention solve is that microfiber mop users do not know the proper amount of water and cleaning solution to use for each microfiber mop head. When microfiber mop heads are under-saturated, they fail to deliver a sufficient amount of cleaning solution to the surface to be cleaned. Consequently, the germs and bacteria on the surface do not receive enough antimicrobial agents to result in those germs and bacteria being killed. In environments where cleanliness is a must, e.g., hospitals and medical offices, this can create a serious health risk.

When too much water or chemicals are added to a microfiber mop head, problems also arise. Too much solution can require the handwringing process described above, which can present health risks to the user. Moreover, too much solution can prevent the cleaned surface from drying properly. This can result in slip and fall risks. This is in addition to the economic loss caused by wasting expensive cleaning solutions.

Embodiments of the present invention solve these issues by providing a measurement canister having a plurality of demarcations disposed along the sidewall. Each demarcation comprises an indicator of a number of mop heads capable of being saturated by a volume of liquid disposed in the canister having a particular demarcation as an upper limit. Accordingly, when a user wants to saturate three mop heads, rather than performing complex arithmetic in his head, the user simply fills the measurement canister until the liquid reaches the "3 Mops" demarcation. Each demarcation, therefore, provides a simple and convenient mechanism for indicating the exact amount of fluid required because each demarcation corresponds to a fluid level suitable for saturating a predetermined number of mop heads. Embodiments of the invention therefore facilitate a simple and clear understanding of just how much liquid is required for a predetermined number of microfiber mop heads. When the process is kept simple, there is little chance of error.

Figure 2:
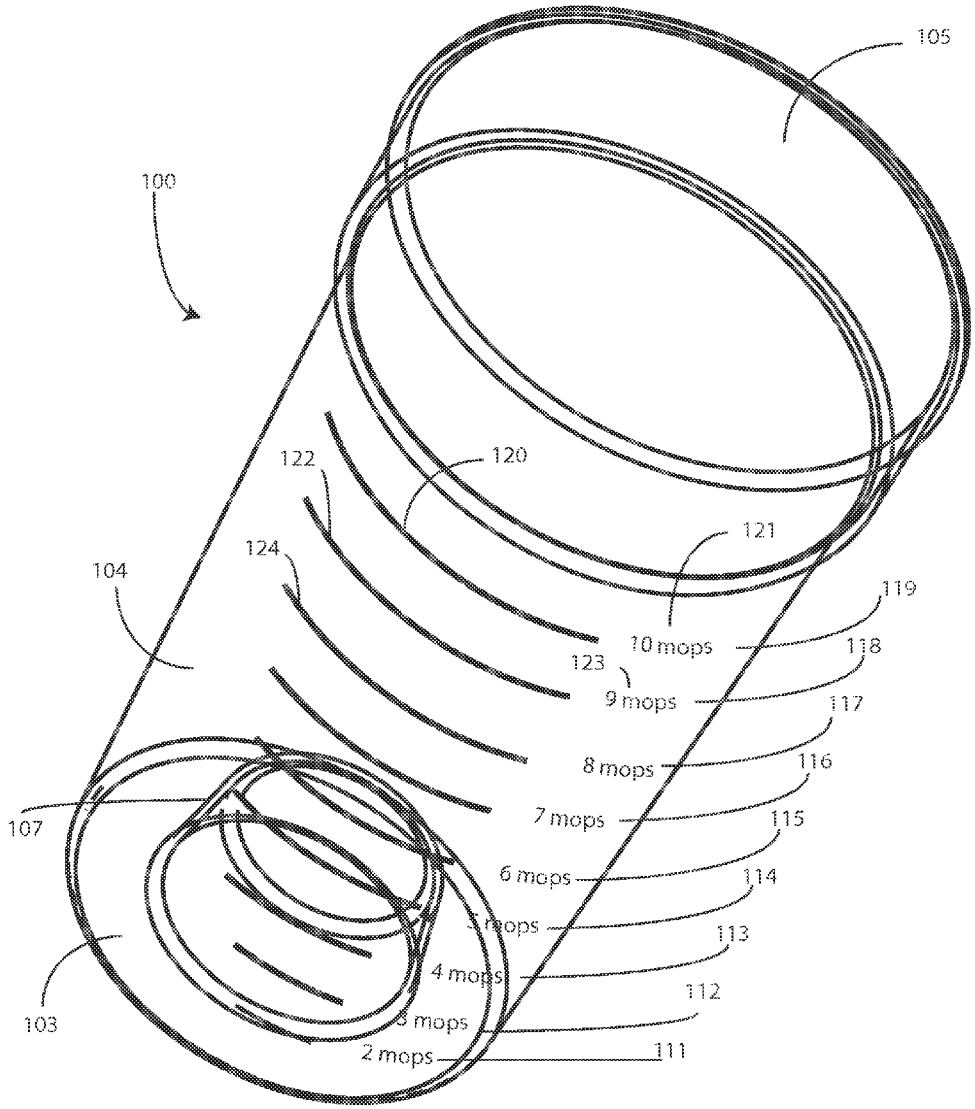
FIG. 2 illustrates a perspective view of one explanatory measurement canister configured in accordance with one or more embodiments of the invention.

Turning now to FIGS. 1 and 2, illustrated therein is one embodiment of a measurement canister 100 configured in accordance with one or more embodiments of the invention. The measurement canister 100 can be manufactured in a variety of sizes. For example, in one embodiment the measurement canister 100 has a height 101 of about 9.75 inches and a base member width 102 of about 4.35 inches. In another embodiment, the measurement canister 100 has a height 101 of about 7 inches and a base member width 102 of about 4.35 inches. The difference between each measurement canister in these illustrative embodiments is the size. The former is a 2400 cc canister, capable of accommodating solution for ten microfiber mop heads, while the latter is is a 1500 cc canister, capable of accommodating six microfiber mop heads. These sizes are exemplary only, and embodiments of the invention are not intended to be limited in this regard, as any of canisters suitable for use with the invention can be created in a wide variety of sizes.

In one embodiment, the measurement canister 100 is manufactured from a clear, substantially rigid thermoplastic by way of an injection molding process. For example, the fluid collection canisters can be manufactured from clear polystyrene, which is also known sometimes by the name "crystal styrene."

The illustrative measurement canister 100 of FIGS. 1 and 2 includes a canister base 103 and a tapered sidewall 104 extending from the canister base to a rim 105. The rim 105 can comprise a lip 106 or other mating feature that is suitable for coupling to or otherwise engaging a lid. The tapered sidewall 104 of this illustrative embodiment extends distally from the canister base 103, both in outward and upward directions, to the rim 105. Either of the tapered sidewall 104 or the rim 105 can be reinforced as desired. The tapering nature of the tapered sidewall 104 can help facilitate release of the measurement canister 100 from a mold when the canisters are manufactured by injection molding. While the sidewall is shown in this illustrative embodiment as being outwardly tapered, those of ordinary skill in the art having the benefit of this disclosure will recognize that the sidewalls can be straight, or inwardly tapered so as to resemble a flask.

In this illustrative embodiment, the measurement canister 100 includes an optional inner protuberance 107 that extends at an angle 108 of about 100 degrees relative to the canister base 103 to a height 108 of about 1.2 inches. The inner protuberance 107 serves as a reinforcement mechanism for the overall measurement canister 100.

In this illustrative embodiment, the tapered sidewall 104 comprises a plurality of demarcations 110,111,112,113,114,115,116,117,118,119 disposed along the tapered sidewall. In one embodiment, each demarcation 110,111,112,113,114,115,116,117,118,119 comprises an indicator of a number of mop heads capable of being saturated by a volume of liquid disposed within the measurement canister 100, when in an upright position, bounded by the canister base 103, the tapered sidewall 104, and having a selected demarcation as an upper limit. For example, if a user desires to saturate four microfiber mop heads with solution, a volume of liquid disposed in the measurement canister 100 having the canister base 103 as its bottom limit, the tapered sidewall 104 as its outer limit, and demarcation 114 as its upper limit would provide the correct amount of solution that could be absorbed by the microfiber mop head. Accordingly, each demarcation 110,111,112,113,114,115,116,117,118,119 corresponds to a fluid level suitable for saturating a predetermined number of mop heads. If the predetermined number is two, demarcation 111 provides the proper fluid level. If the predetermined number is four, demarcation 113 provides the proper fluid level, and so forth.

In this illustrative embodiment, each demarcation 110,111,112,113,114,115,116,117,118,119 comprises a curvilinear demarcator and the words "X mops," wherein X is a value within a predetermined range. For example, demarcation 119 comprises curvilinear demarcator 120 and the words 121 "10 mops." Similarly, demarcation 118 comprises curvilinear demarcator 122 and the words 123 "9 mops." These demarcations 110,111,112,113,114,115,116,117,118,119 aid users in determining the proper measurements of water and chemicals for a predetermined number of microfiber mop heads. The demarcations 110,111,112,113,114,115,116,117,118,119 further eliminate questions regarding quantities or volumes required, as well as eliminate the need for complicated unit conversion calculations.

In the illustrative embodiment of FIGS. 1 and 2, the demarcations 110,111,112,113,114,115,116,117,118,119 are configured to be inversely tapered such that each demarcation becomes shorter as the tapered sidewall 104 extends from the rim 105 to the canister base 103. Accordingly, demarcation 119 is longer than demarcation 118. Demarcation 118 is longer than demarcation 117, and so forth. In this embodiment, the inverse tapering is caused by the demarcators of each demarcation extending less to the right, as viewed in FIG. 1. For example, curvilinear demarcator 120 extends further to the right than does curvilinear demarcator 122. Similarly, demarcator 122 extends further to the right than does curvilinear demarcator 124. This inverse tapering provides a mnemonic device to the user in that the longer the curvilinear demarcator, the more mops that can be saturated by that amount of liquid. Said differently, since curvilinear demarcator 120 is longer than curvilinear demarcator 124, filling liquid to curvilinear demarcator 120 will saturate more microfiber mop heads than will filling liquid to curvilinear demarcator 124.

In one or more embodiments, the demarcations 110,111,112,113,114,115,116,117,118,119 correspond to a predetermined range of microfiber mop heads that can be saturated. In this illustrative embodiment, the predetermined range is 1 to 10 microfiber mop heads, inclusive. Accordingly, filling liquid into the measurement canister 100 to the first demarcation 110 provides enough liquid to saturate a single microfiber mop head, while filling the measurement canister 100 to the last demarcation 119 provides enough liquid to saturate ten microfiber mop heads. The predetermined range of one-to-ten is illustrative only. Other ranges will be obvious to those of ordinary skill in the art having the benefit of this disclosure. As noted above, in another embodiment the measurement canister 100 is only 1500 cc. For such a canister, the predetermined range might be one-to-six.

In this illustrative embodiment, each demarcation 110,111,112,113,114,115,116,117,118,119 corresponds to an increase of six fluid ounces. As will be described below, in one embodiment the measurement canister 100 is configured for use with 18"×4" 80/20 polyester/polyimide microfiber mop heads. Experimental testing has shown that such a mop head is capable of absorbing six ounces of water and/or cleaning solution and providing desired cleaning results. Accordingly, in one embodiment each demarcation 110,111,112,113,114,115,116,117,118,119 is set to six-ounce increments. Consequently, filling the measurement canister 100 to curvilinear demarcator 120 would add six ounces more to the measurement canister 100 than would filling to curvilinear demarcator 122. While six-ounce increments are one alternative, others will be readily apparent to those of ordinary skill in the art having the benefit of this disclosure.

Figure 3:
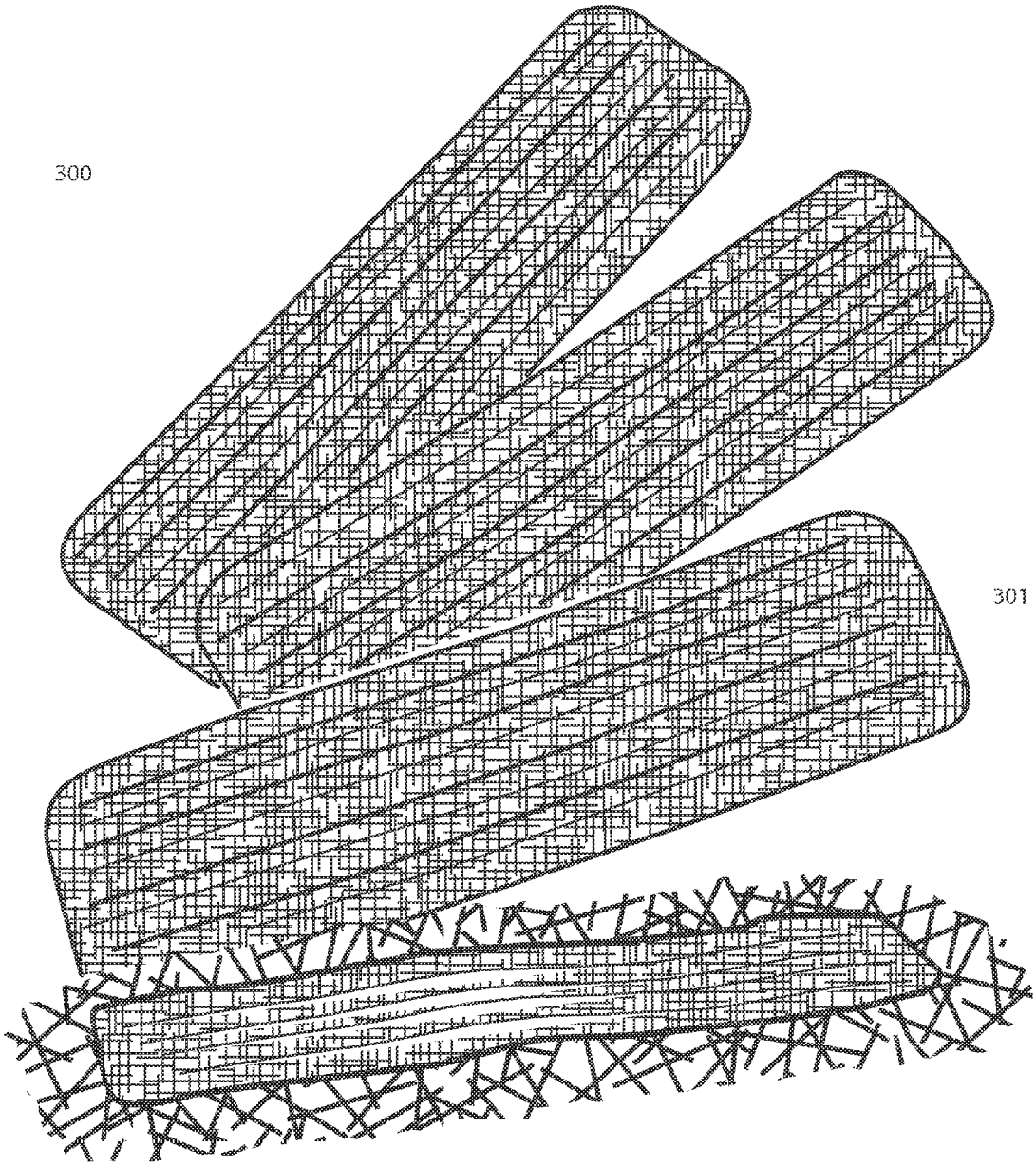
FIG. 3 illustrates a perspective view of explanatory microfiber mop heads suitable for use with one or more embodiments of the invention.

Turning now to FIG. 3, illustrated therein are examples of microfiber mop heads 300 suitable for use with embodiments of the invention. Microfiber mop heads 300 are densely constructed nylon fiber elements that use a blend of fibers, typically polyester and polyamide, that are approximately 1/16 the thickness of a human hair. The inherent densities of these microfibers enable mop heads manufactured from those fibers it to hold six times their weight in water. This property makes microfibers more absorbent than a conventional, cotton sting mops.

Another advantage of microfiber mop heads is that they can be positively charged to attract dust. Dust tends to have a negative charge. Accordingly, the positively charged microfibers have an electrostatic attraction to dust, and are able to cling to dust and dirt more effectively than non-synthetic materials such as cotton. The microfibers also are better able to penetrate the microscopic surface pores found in most flooring materials.

In one embodiment, a microfiber mop head 301 configured for use with the measurement canister (100) described above is an 18" by 4" microfiber mop head. The microfiber mop head 301 is manufactured from 80 percent polyester and 20 percent polyimide. Such a microfiber mop head 301 is well suited to cleaning a single hospital room or doctor's examination room. Accordingly, ten microfiber mop heads having this configuration can clean ten rooms. Experimental testing has shown that such a microfiber mop head 301 is able to comfortably absorb six fluid ounces of solution.

Figure 4:
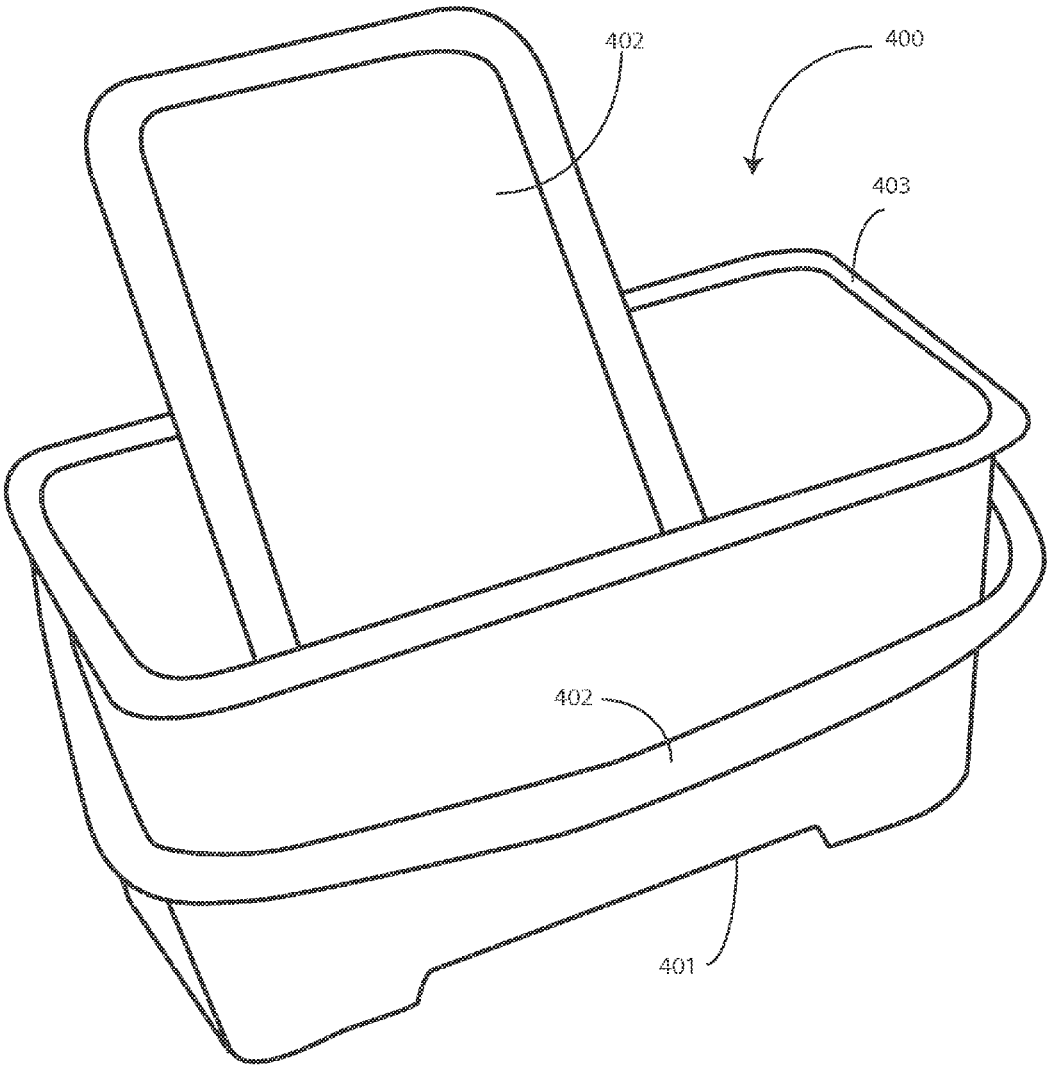
FIG. 4 illustrates one embodiment of an explanatory bucket suitable for use with methods and systems described herein.
Figure 5:
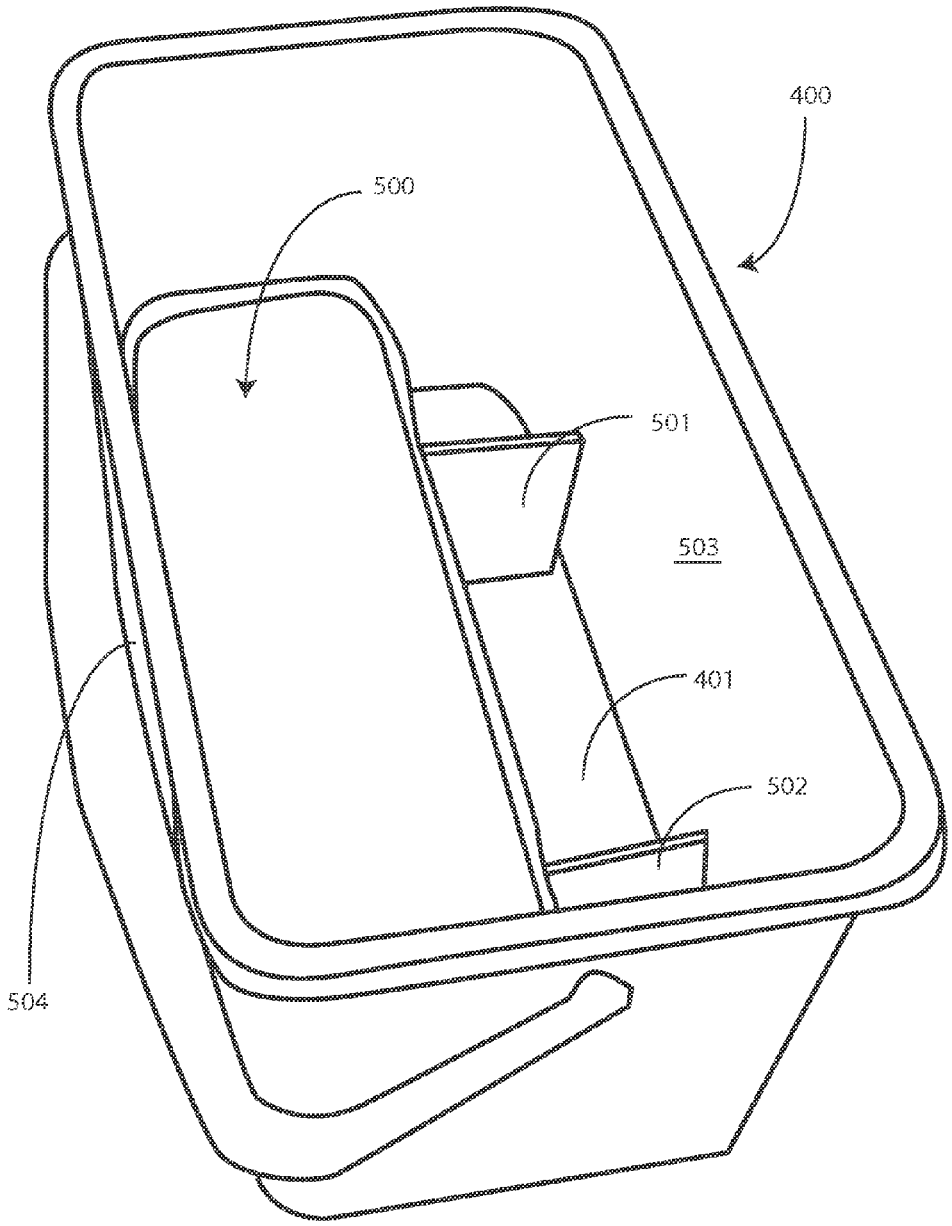
FIG. 5 illustrates one or more microfiber mop heads being disposed in a bucket configured in accordance with one or more embodiments of the invention.

Turning now to FIGS. 4 and 5, illustrated therein is a bucket 400 configured in accordance with one embodiment of the invention to retain a predetermined number of microfiber mop heads 500 against a base 401 of the bucket 400. In one embodiment, the bucket 400 includes two mop head retention members 501,502 that extend from a side 503 of the bucket 400 inward toward the bucket's interior. The predetermined number of mop heads 500, which in one embodiment comprises between one and ten mop heads, sit between the mop head retention members 501,502 and the opposite wall 504. Each of the mop heads in this illustrative embodiment has one of a hook or loop fastener 505 disposed along an upper side of the mop head. The fastener 505, which can be either hook or loop, is configured to attach to a complementary fastener on a corresponding mop. For example, if the fastener 505 on the mop head is loops, the complementary fastener on the mop would be hooks, or vice versa.

The bucket 400 of this illustrative embodiment includes an optional lid 402 that is configured to be selectively attachable to a lip 403 of the bucket 400. When the lid 402 is attached to the lip 403, the bucket 400 transforms into a sealed container.

To use the components of a system configured in accordance with embodiments of the invention, a user first places the predetermined number of mop heads 500 into the bucket 400 as shown in FIG. 5. The selected or predetermined number of mop heads 500 are placed between the mop head retention members 501,502 and the opposite wall 504 such that they rest against the base 401 of the bucket 400.

Figure 6:
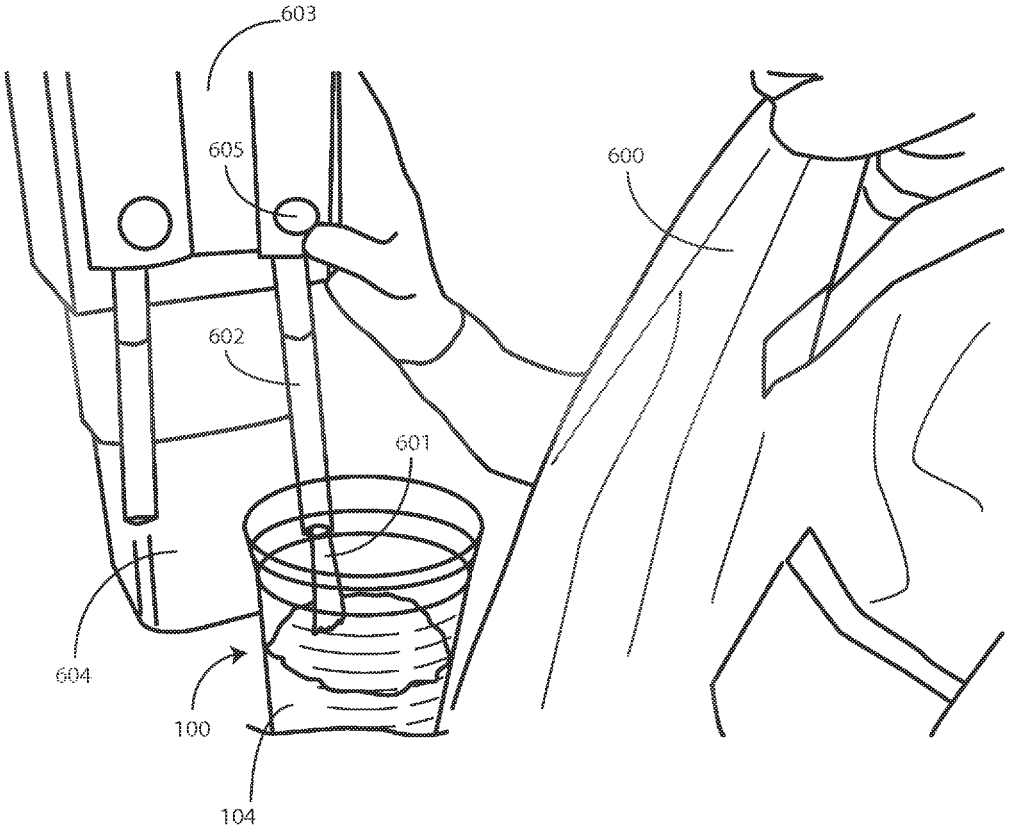
FIG. 6 illustrates a user filling an explanatory measurement container configured in accordance with one or more embodiments of the invention.

Once this step is complete, turning now to FIG. 6, a user 600 obtains a measurement canister 100 comprising a plurality of demarcations disposed along a tapered sidewall 104. As noted above, each demarcation comprises indicia of a predetermined number of mop heads. The user 600 knows the predetermined number because it is the selected number placed into the bucket (400) in FIG. 5. Accordingly, the user fills the measurement canister 100 with a cleaning fluid 601 to one of the demarcations corresponding to the selected number of mop heads.

In this illustrative embodiment, the user 600 fills the measurement canister 100 by placing the measurement canister 100 under the nozzle 602 of a dispenser 603. A container 604 of fluid 601 configured for measurement in the measurement canister 100 is attached to the bottom of the dispenser 603. The user 600 depresses a button 605, which causes the fluid 601 to flow into the measurement canister 100. Once the fluid reaches the demarcation corresponding to the selected number of mops, the user 600 releases the button 605, thereby stopping the fluid 601 from flowing. Thus, if the user 600 plans to saturate six mop heads, the user 600 simply holds the button 605 until the fluid 601 reaches the demarcation reciting "6 mops." This provides a quick and simple way to instantly know exactly how much fluid 601 is required for a particular number of mop heads. Moreover, this ensures that all fluid 601 required for proper cleaning will be absorbed, and that none will be wasted.

Figure 7:
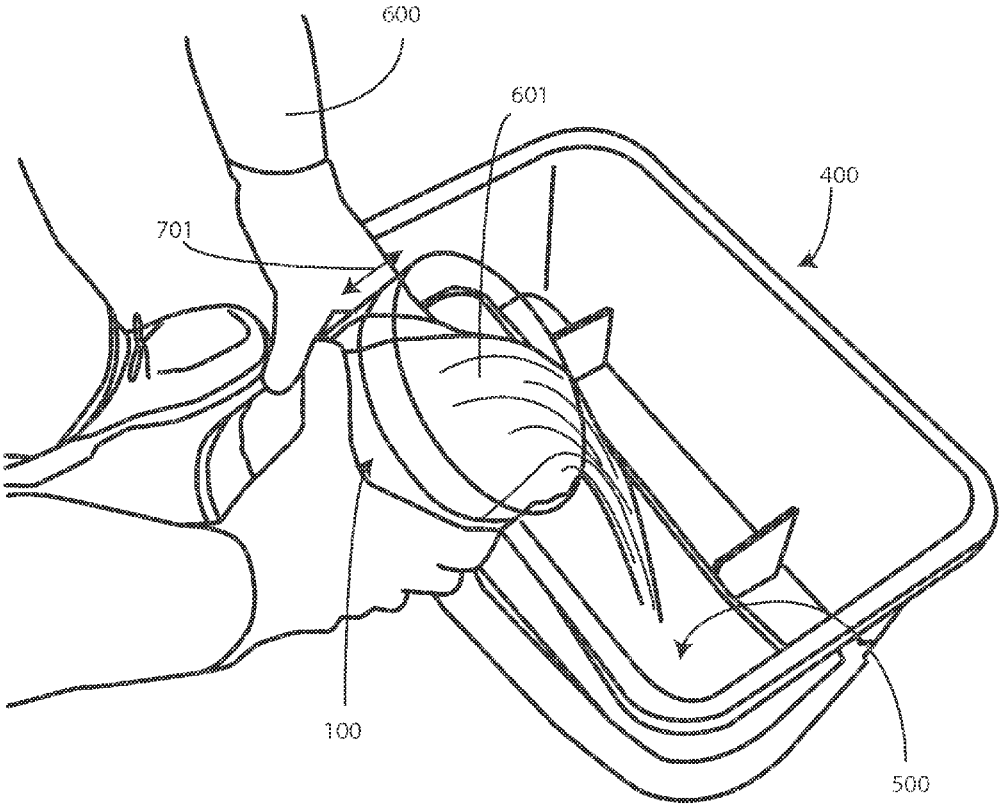
FIG. 7 illustrates a user pouring cleaning solution measured with one explanatory measurement canister configured in accordance with embodiments of the invention into an explanatory bucket configured in accordance with embodiments of the invention.

Turning to FIG. 7, once the proper amount of fluid 601 is measured, the user 600 pours the fluid 601 into the bucket 400 over the selected number of mop heads 500. Note that in one embodiment, the measurement canister 100 has enough space 701 above the uppermost demarcation to prevent spillage when pouring. For example, if the uppermost demarcation is "10 mops," in one embodiment the measurement canister will include a sufficient amount of volumetric space 701 above this demarcation to allow the user 600 to tilt the measurement canister 100 over the bucket 400 without spilling any of the fluid 601. As conservation of fluid 601 is one of the primary goals of embodiments of the invention, prevention of spillage is an important consideration.

Once the user 600 has poured the fluid 601 over the predetermined number of mop heads 500, time is allowed for the predetermined number of mop heads 500 to absorb the fluid. If the fluid 601 was filled to the proper demarcation, all of the fluid should be absorbed by the predetermined number of mop heads 500.

Once this is complete, turning now to FIG. 7, the user (600) places the head 801 of a mop 800 into the bucket 400. Recall from above that in one embodiment, each of the predetermined number of mop heads 500 comprises one of a hook or loop fastener, while the head 801 of the mop 800 comprises another of the hook or loop fastener. In this illustrative embodiment, the head 801 of the mop 800 comprises hooks, while the upper side of each of the predetermined number of mop heads 500 comprises loops. Accordingly, the user (600) can simply press the head 801 of the mop 800 onto the top of the uppermost mop head to attach it to the mop 800. This eliminates any need of touching the mop heads, which prevents skin irritation or burns. Further, since all of the fluid (601) was absorbed, there is no need for handwringing as there is with prior art embodiments.

Figure 8:
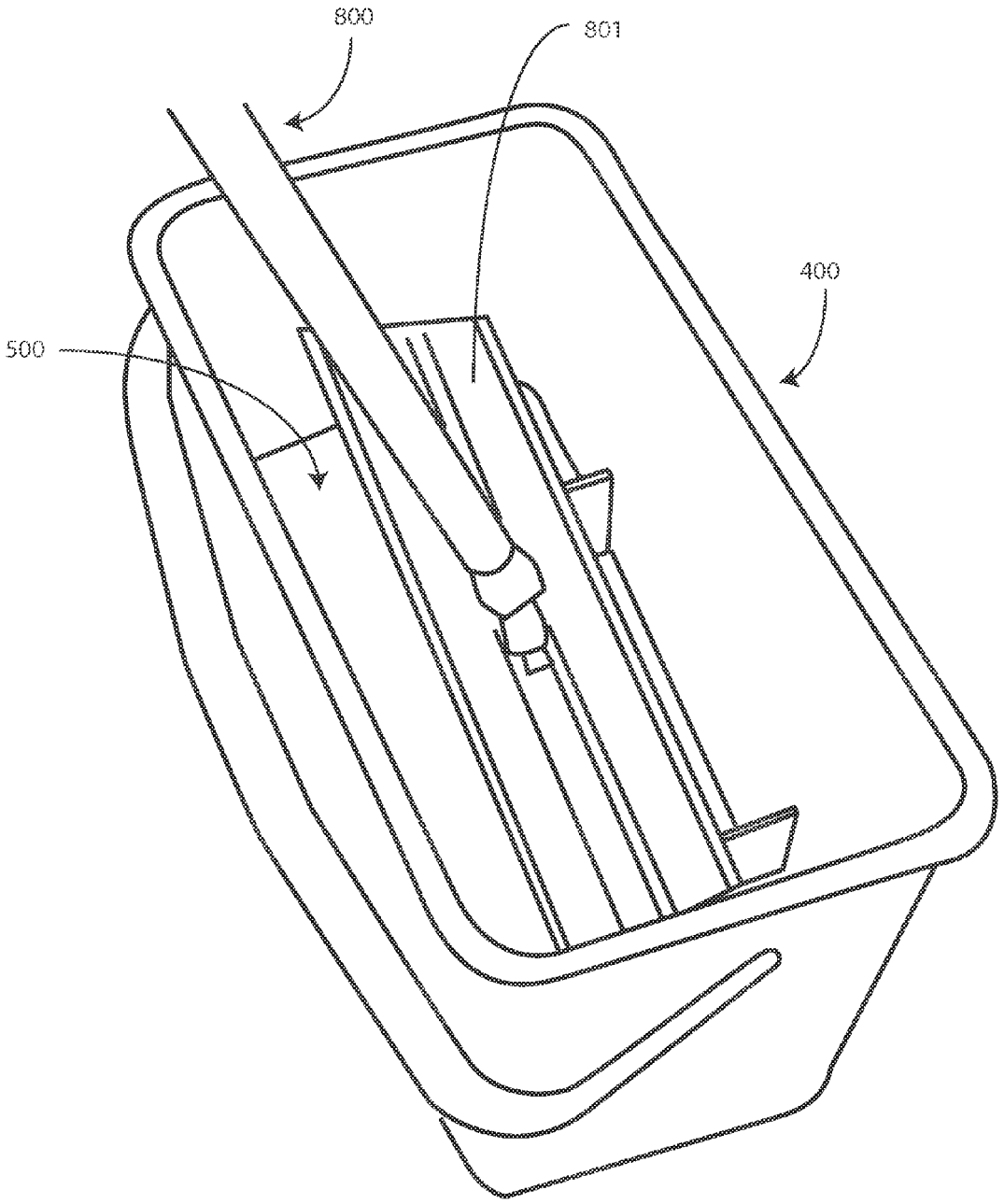
FIG. 8 illustrates a user inserting a mop into one explanatory bucket configured in accordance with one or more embodiments of the invention.
Figure 9:
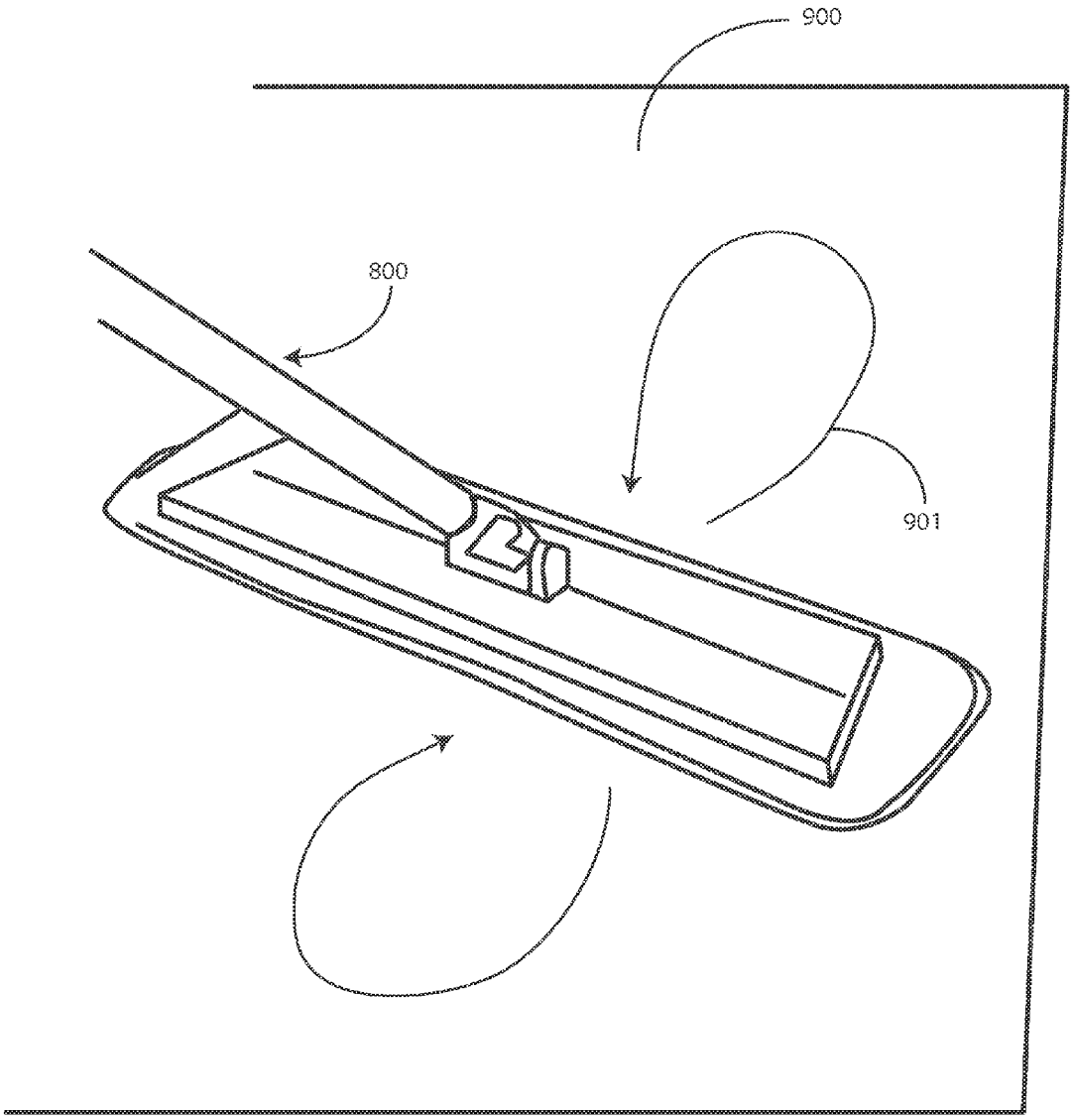
FIG. 9 illustrates a user mopping in accordance with one or more embodiments of the invention.

With the mop head securely attached to the mop 800, the user (600) can mop as shown in FIG. 9. Turning now to FIG. 9, the user (600) is moving the mop 800 in a figure-8 motion 901 along a floor 900.

Figure 10:
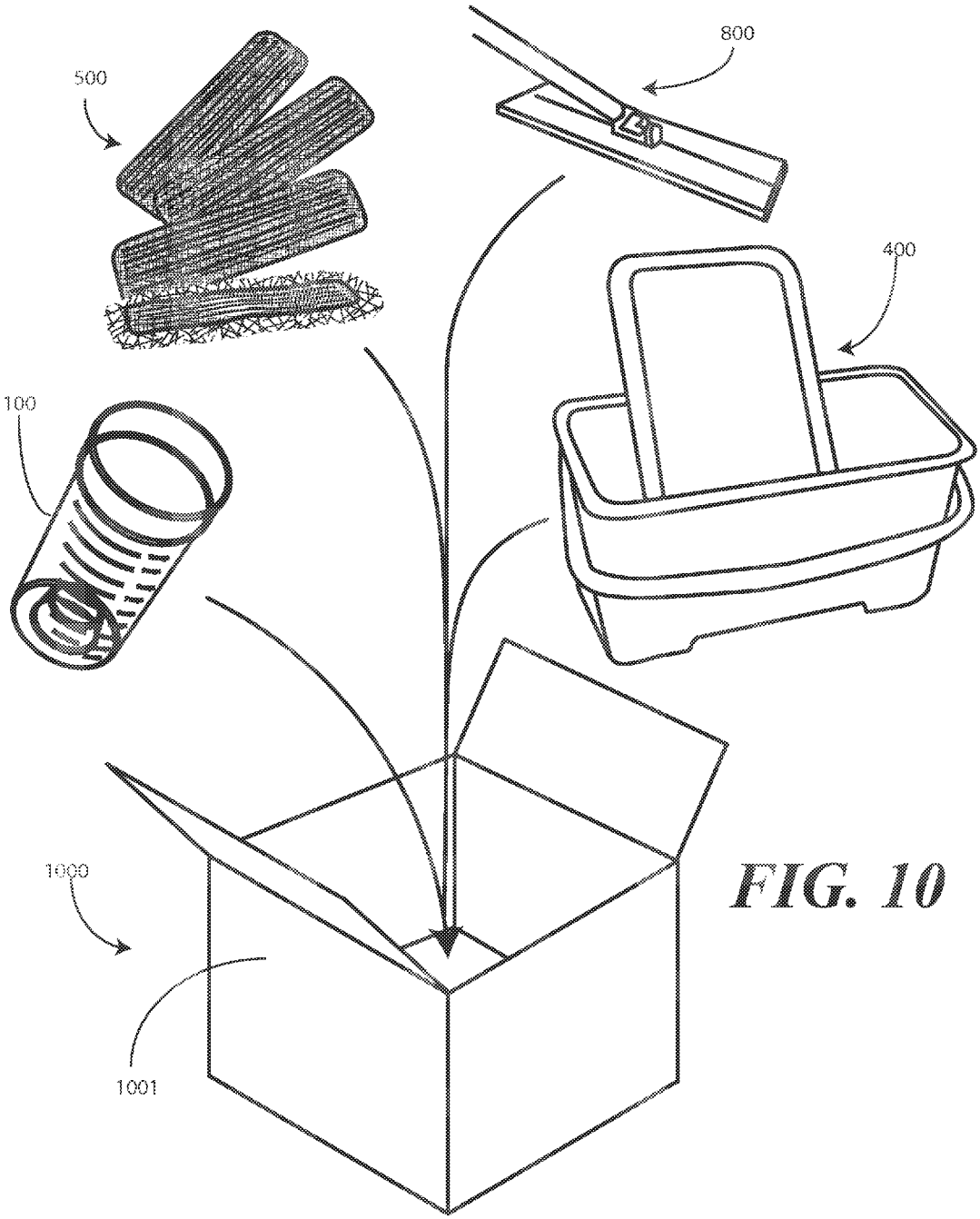
FIG. 10 illustrates one explanatory mop kit configured in accordance with one or more embodiments of the invention.

Components of embodiments of the invention can, of course, be sold separately. However, in one or more embodiments, various components can be sold as a kit. Turning now to FIG. 10, illustrated therein is one embodiment of such a kit 1000.

As shown in FIG. 10, the explanatory kit 1000 of this illustrative embodiment includes a measurement canister 100 comprising a plurality of demarcations disposed along a sidewall, wherein each demarcation corresponds to a fluid level suitable for saturating a predetermined number of mop heads. A bucket 400 configured to retain the predetermined number of mop heads against along a base of the bucket is also included. These components can be packaged in a box 1001 or other suitable container.

In one embodiment, the kit 1000 also includes a predetermined number of mop heads 500. In one embodiment, the predetermined number of mop heads 500 includes 100 mop heads. In one embodiment, the predetermined number of mop heads 500 are microfiber mop heads. In one embodiment, the predetermined number of mop heads 500 are 18" by 4" 80/20 polyester/polyimide microfiber mop heads.

The kit 1000 can optionally include one or more containers of fluid configured for measurement in the canister and for saturation of one or more of the predetermined number of mop heads. An example of such a container (604) is shown in FIG. 6. In one embodiment, the container (604) is configured for attachment to a dispenser (603) like that shown in FIG. 6. The kit 1000 can optionally include the dispenser (603) as well.

The kit 1000 can also optionally include a mop 800. In another embodiment, the kit 1000 includes a plurality of mops. Whether one or many, in one embodiment each of the mop heads 500 comprises one of a hook or loop fastener, while the mop 800 comprises another of the hook or loop fastener.

Figure 11:
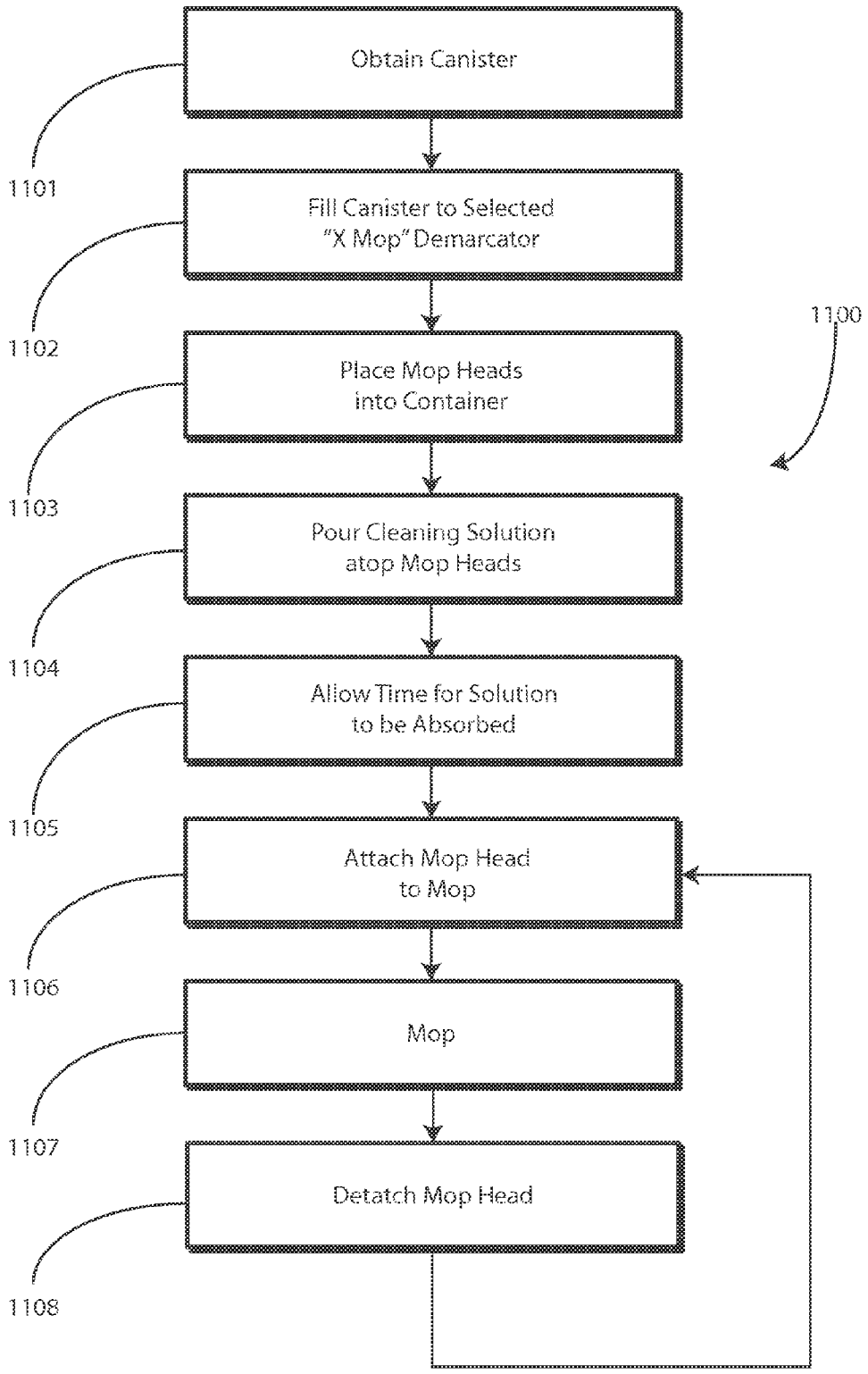
FIG. 11 illustrates one explanatory method of using a mop kit in accordance with one or more embodiments of the invention.

Turning now to FIG. 11, illustrated therein is one explanatory method 1100 of saturating and using a mop in accordance with embodiments of the present invention. Many of the method steps have been described above with reference to FIGS. 5-9. As such, they will only be cursorily repeated here.

At step 1101, a user obtains a canister having demarcations disposed along a sidewall, wherein each demarcation comprises indicia of a predetermined number of mop heads. At step 1102, the user fills the canister with a cleaning fluid to one of the demarcations. In one embodiment, step 1102 comprises determining how many mop heads will be used, and then selecting the demarcations corresponding to the selected number of mop heads.

At step 1103, the user places the selected number of mop heads in a container. In one embodiment, the container is a bucket configured to retain the predetermined number of mop heads against along a base of the bucket. Note that step 1103 can occur prior to, or after, step 1102.

At step 1104, the user pours the cleaning fluid into the container. At step 1105, the user waits until the cleaning fluid has been absorbed by the selected number of mop heads. At step 1106, the user attaches a mop to an upper-most mop head of the selected number of mop heads. At step 1107, the user mops. At step 1108, the user detaches the mop head from the mop for laundering. This step 1108 is done, in one embodiment, by stepping on an edge of the mop head and separating the hook and loop fasteners holding the mop head to the mop. The user can then rotate the head of the mop by 90 degrees, to attach the mop head to the mop at an orthogonal alignment. The user can then place the mop head over a laundry bin and pull the mop head from the mop. Where the user desires to keep mopping, the method 1100 can return to step 1106, where the user attaches the next upper-most mop head to the mop and repeats steps 1106-1108 until the predetermined number of mop heads is exhausted.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A mop kit, comprising:

a canister comprising a plurality of demarcations disposed along a sidewall, each demarcation indicating a predetermined number of mop heads capable of being saturated by a volume of liquid in the canister;

a bucket configured to retain the predetermined number of mop heads along a base of the bucket; and the predetermined number of mop heads.

2. The mop kit of claim 1, further comprising one or more containers of fluid configured for measurement in the canister and for saturation of one or more of the predetermined number of mop heads.

3. The mop kit of claim 2, further comprising a mop.

4. The mop kit of claim 3, wherein each of the predetermined number of mop heads comprises one of a hook or loop fastener, and the mop comprises another of the hook or loop fastener.

5. The mop kit of claim 2, further comprising a dispenser for the one or more containers of fluid.

6. The mop kit of claim 1, the canister comprising a canister base, the sidewall comprising a tapered sidewall extending from the canister base to a rim, and the volume of liquid in the measurement canister having the each demarcation as an upper limit.

7. The mop kit of claim 6, the each demarcation comprising a curvilinear demarcator.

8. The mop kit of claim 7, the plurality of demarcations inversely tapered such that the each demarcation becomes shorter as the tapered sidewall extends from the rim to the canister base.

9. The mop kit of claim 7, the each of the plurality of demarcations further comprising words "X mops," wherein X is a value within a predetermined range.

10. The mop kit of claim 9, the predetermined range comprising values between 1 and 10, inclusive.

11. The mop kit of claim 6, the number of mop heads comprising microfiber mop heads.

12. The mop kit of claim 11, the microfiber mop heads comprising about eighty percent polyester and about twenty percent polyamide.

13. The mop kit of claim 6, the volume of liquid comprising a multiple of six ounces.

* * * * *